United States Patent [19]

Smith

[11] Patent Number: 4,924,841

[45] Date of Patent: May 15, 1990

[54] ARROW GUIDE

[76] Inventor: Robert D. Smith, 1715 Oleander Ave., Chico, Calif. 95926

[21] Appl. No.: 389,677

[22] Filed: Aug. 3, 1989

[51] Int. Cl.[5] ..... F41B 5/00

[52] U.S. Cl. ..... 124/44.5

[58] Field of Search ..... 124/24 R, 41 A, 86, 124/88

[56] References Cited

U.S. PATENT DOCUMENTS

| | | | |
|---|---|---|---|
| 2,980,097 | 4/1961 | Rothgery | 124/41 A |
| 3,769,956 | 11/1973 | Simo | 124/41 A |
| 3,935,854 | 2/1976 | Troncoso | 124/24 R |
| 4,133,334 | 1/1979 | Tone | 124/41 A |
| 4,473,058 | 9/1984 | Terry | 124/24 R |
| 4,796,597 | 1/1989 | Farro | 124/41 A |
| 4,809,669 | 3/1989 | Saunders | 124/24 R |

*Primary Examiner*—Randolph A. Reese
*Assistant Examiner*—John A. Ricci

[57] ABSTRACT

An arrow guide having vertical arrow levering and horizontal arrow cushioning is fully adjustable and easily repaired. A hinge plate is attached to an archery bow riser adjacent the handle grip retained by a hollow threaded fastener passed through an aperture common to most modern bows and secured by a lock nut. A spring biased plunger housed in the threaded fastener protruding from the face of the hinge plate providing horizontal arrow cushioning. An arrow rest lever rod adapted for non-restrictive resting of the arrow for aiming is provided with self spring biasing to move forward with the arrow movement and return to a reuse position angled lateral relative to the hinge plate.

4 Claims, 4 Drawing Sheets

ARROW GUIDE

BACKGROUND OF THE INVENTION

1. Field of the Invention

This invention relates to devices attachable to archery bows for levering and guiding arrows during shooting. The present invention is particularly directed towards a device designed for quick easy maintenance and sturdy durability to facilitate repeated consistent duplication of arrow flight.

2. Description of the Prior Art

Since most archers prefer a bow that will shoot arrows accurately, the need for accessory guide systems which help to maintain the consistency of the trajectory of the arrow became obvious. A variety of arrow guides and arrow rests soon were produced and made available to the serious archer. The majority of these arrow rests and guides, however, are not adjustable and not easily repaired or replaced when damaged. Some available arrow rests are mounted with adhesive material that is adversely effected by temperature change. Most rests have no adjustment of any kind, thus the bow must be adjusted to the rest position. When an arrow rest is damaged and must be replaced with a new one, most available rests cannot be replaced by a simple change of the arrow rest in the base plate. With the arrow rest not being replaceable in the same base plate, the arrow support system provides no means for duplicating the previously set mounted position or performance of the previous arrow rest. Excess time must therefore be consumed during the task of adjusting the arrow rest and supporting base and shooting repeatedly until the bow shoots correctly again.

Some arrow rest devices have spring type guides and supports which have no mechanics for adjusting the spring tension. Spring tension adjustment without movement of the guide is essential for true arrow flight. Other rigid arrow rests which have no spring action offer no cushioning effect to reduce human errors thus limiting arrow to target accuracy.

A past art patent search disclosed two patents showing devices useful as arrow rests and guides which appeared most pertinent to my invention. The two include a patent granted to Tone, patent number 4,133,334, allowed on Jan. 9, 1979, for "Flipper Type Arrow Rest" and a patent issued to Simo, patent number 3,769,956, on Nov. 6, 1973, for "Arrow Rest For Archery Bow". Both Tone and Simo mount their devices to the bow with adhesives, which either permanently mar the surface of the bow or become ineffective in both damp and hot weather. The devices both show pivotal horizontal arrow supports which are not removable. Should these supports be damaged, the entire unit must be replaced. Tone and Sino both show devices having wide surfaced plunger cushion buttons which tend to create excess frictional drag on the arrow. In neither of these patented devices is a cushion button adjustable to arrow types illustrated or disclosed.

Although considerable excellent archery equipment is available, a common failure exists in not providing immediate replacement mechanics for arrow rest and guide devices. Arrow rest and guide assemblies that can be restored to original performance capability quickly and easily in the field have not been available. Until the advent of the immediate invention, this quality of repair has been impossible with any competitive product available to my knowledge.

SUMMARY OF THE INVENTION

Therefore, in practicing my invention, I have provided an arrow guide having vertical arrow levering and horizontal arrow cushioning which is fully adjustable and easily repaired. The arrow guide according to the invention has a single mount that utlizes a bow riser aperture common to nearly all modern bows. Additionally, the arrow guide of this invention provides an easily replaceable and adjustable spring biased arrow rest.

Basic to my arrow guide, is a small rectangular flat metal or plastic plate which I call a hinge plate. The hinge plate is attached to an archery bow riser adjacent the handle grip retained by a hollow threaded fastener and lock nut. The hollow threaded fastener is tubular and has internal and external threading. For attaching the hinge base on the arrow rest side of the bow, the hollow threaded fastener is passed through an aperture normally provided for the purpose of most modern bows. The hinge base is aligned on the bow handle to be useful with the nocking point on the bowstring. A small lever-like elongated metal wire rod referred to hereinafter as the arrow rest lever rod has a straight rod section from a first terminal end for approximately half its length then is bent into a looping right angled section for approximately half the remaining length with the other remaining half then returned in a straight section having a second terminal approximately even with the first straight section. The returned second terminal ended straight section is aligned truly right angled to the original straight rod section at the first terminal end. The straight second terminal end section is arranged to fit pivotally into a bore transversely opened through the hinge base adjacent the right hand short end in the top edge. An inside lip cut along the same shorter right hand edge of the hinge base is aligned paralleling the bore length. A small notch is opened at the bottom in the lip step. When the right angled straignt second terminal end section of the arrow rest lever rod is forced down into the bore in the hinge base, the angled end section of the rod can be snapped into the lip cut with the lower rounded corner retained in the notch at the bottom of the lip step. Attached in this manner, the straignt rod section ending at the first terminal end aligns parallel with the longitudinal bottom edge of the hinge base. In this attachment, the looping right angled section acts as an inherent biasing spring applying sufficient pressure to the rod structure to position the first terminal end straight section angled laterally out from the lower edge of the hinge base. The lip step notch acts as a brake maintaining the rod angled properly to be useful as an arrow rest during shooting. The rod attachment is pivotal and the inherent spring biasing which is strong enough to return the arrow rest lever rod to an angled use position, is not strong enough to prevent the lever rod from swinging back under the hinge base when a light force is applied. Any forward movement of a rested arrow will swing the arrow rest lever rod section to a position under the lower edge of the hinge base providing free and unrestricted passage for the fletched end of the arrow to pass.

Important to the immediate invention is the fact that the arrow rest lever can be easily removed and replaced when desired. Horizontal guidance to keep the edge of the arrow away from the surface of the plate base is also provided with a spring-tension activated guide. The spring-tension activated arrow guide is a small round ended plunger which projects outward from the center face of the base plate. The plunger, which is housed inside the hollow threaded fastener used for mounting the hinge base to the bow riser, can be horizontally adjusted and stabilized within the hinge base. With the hinge base secured to the bow by attachment of the hollow threaded fastener to a threaded aperture centrally in the hinge base and secured by a lock nut on the opposite side of the bow, the arrow guide is then assembled and ready for use. An arrow levered on the arrow rest lever rod and cushioned along the bow side by the smooth curved plunger head can be accurately aimed and shot. The arrow rest lever rod moves out of the way as the arrow moves and the smooth cushiony end of the plunger retracts against the internal spring leaving the arrow an unrestricted path to eject from the bow.

For arrow rest level testing, the arrow rest lever rod can be pivoted over flush against the bottom edge of the hinge base and checked for correct level positioning. The level of the arrow rest can be gauged by its parallel position relative to the bottom edge of the hinge base plate. Adjustments in the horizontal positioning of the arrow rest lever rod can then be accomplished by manual bending. The arrow rest lever rod can be easily snapped out of the hinge base bore and replaced or the original straightened and reinstalled.

Therefore, it is a primary object of my invention to provide an arrow rest and guide which can be replaced, all or in part, quickly and easily and without the use of tools or without altering the structure of the bow.

Another object of my invention is to provide an arrow rest and guide which, after replacement, maintains correct positioning of the arrow, thus eliminating time consuming re-positioning with repeated shootings.

A further object of the invention is to provide an arrow rest and guide having a spring biased horizontal arrow support which is adjustable and has reduced frictional effect on the arrow.

An even further object of the invention is to provide an arrow rest and guide which contains a built-in stationary check point to quickly ensure correct positioning of the lever.

A still further object of the invention is to provide an arrow rest and guide with automatic self-adjustments which retract and do not deflect the fletching of the arrow as it is launched.

Further objects and advantages of my invention will become apparent from viewing numbered parts illustrated in the drawings considered in light of similar numbered parts described in this specification.

DESCRIPTION OF THE PREFERRED EMBODIMENT

Figure 1:
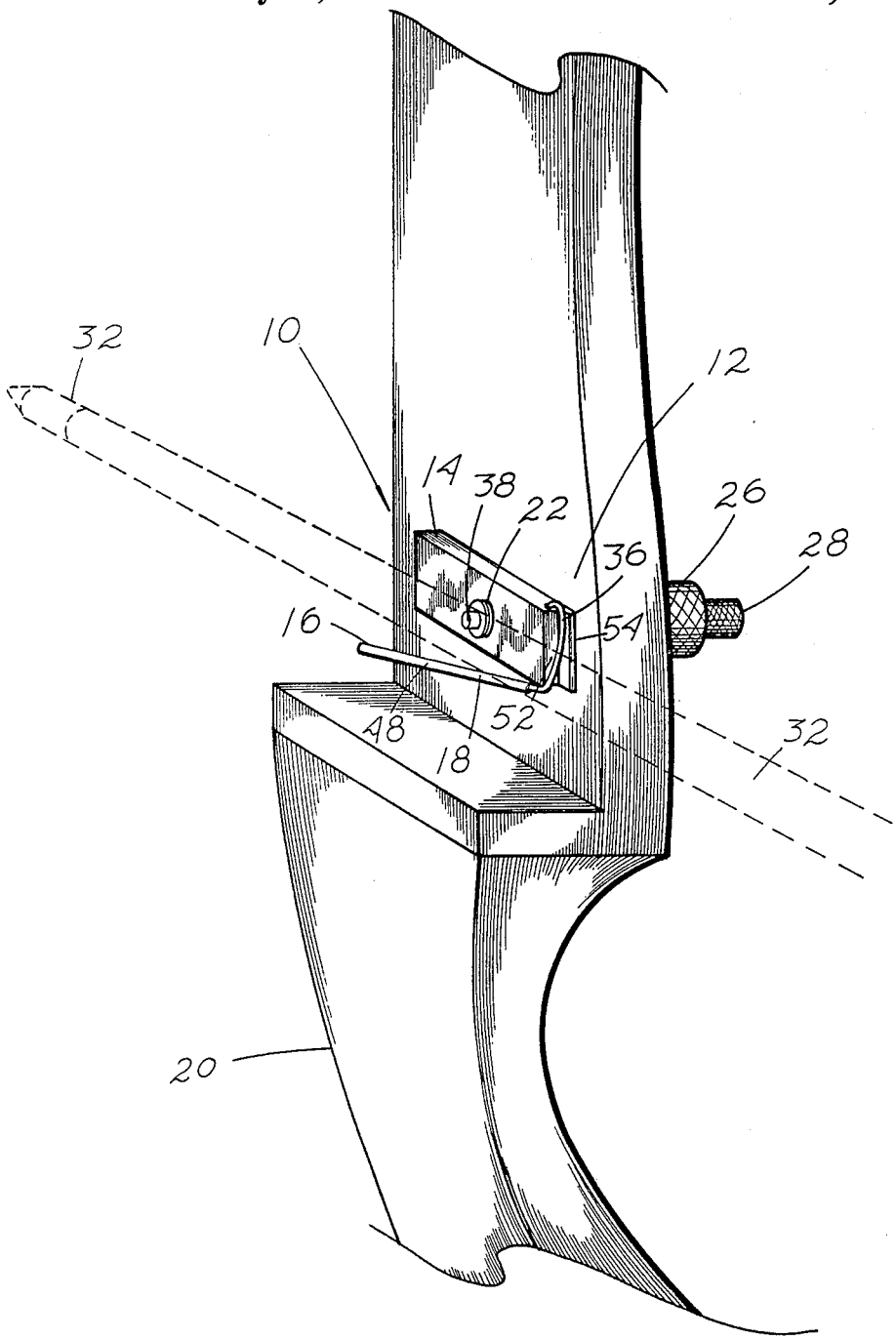
FIG. 1 is a perspective view of the arrow guide according to the invention shown mounted on the riser of a bow.
Figure 2:
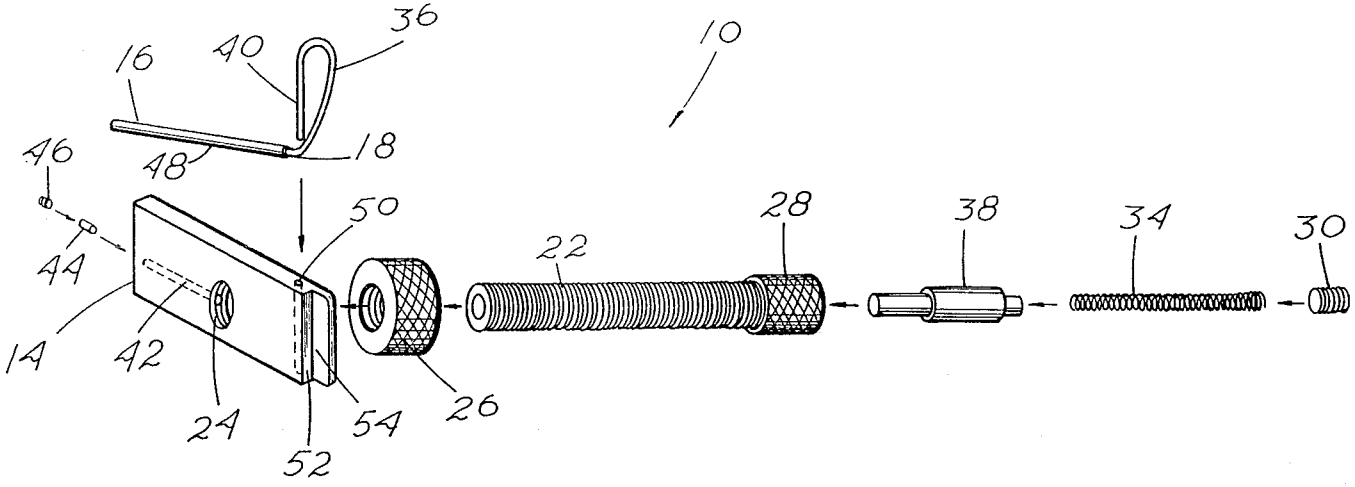
FIG. 2 is an exploded view of the arrow guide showing all parts in order of assembly.
Figure 3:
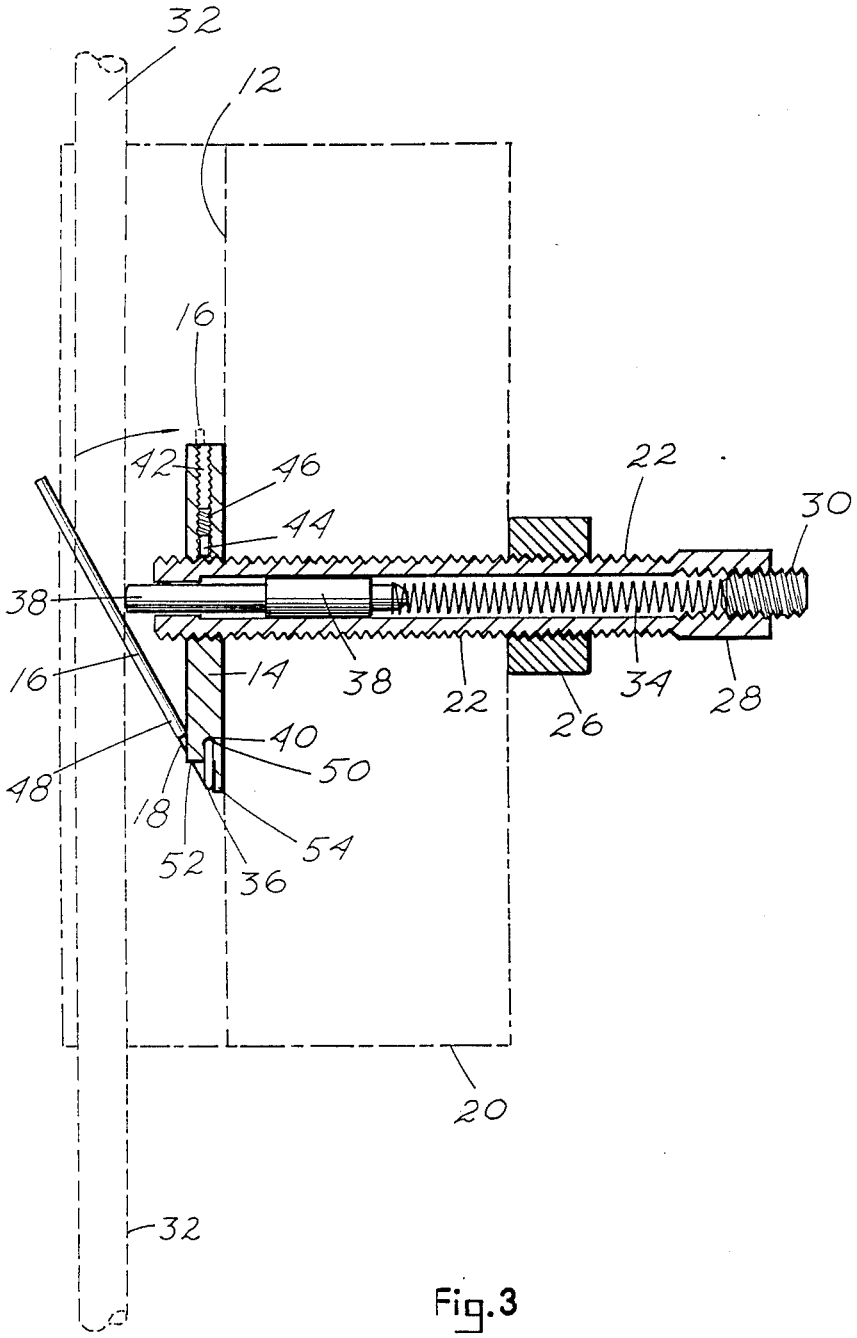
FIG. 3 is an enlarged view of the arrow guide assemblage as seen from the top. The hollow threaded fastener is sectioned to expose the arrow guide parts. Normal positioning and swing away action of the arrow support lever are shown. A dotted outline represents the bow.
Figure 4:
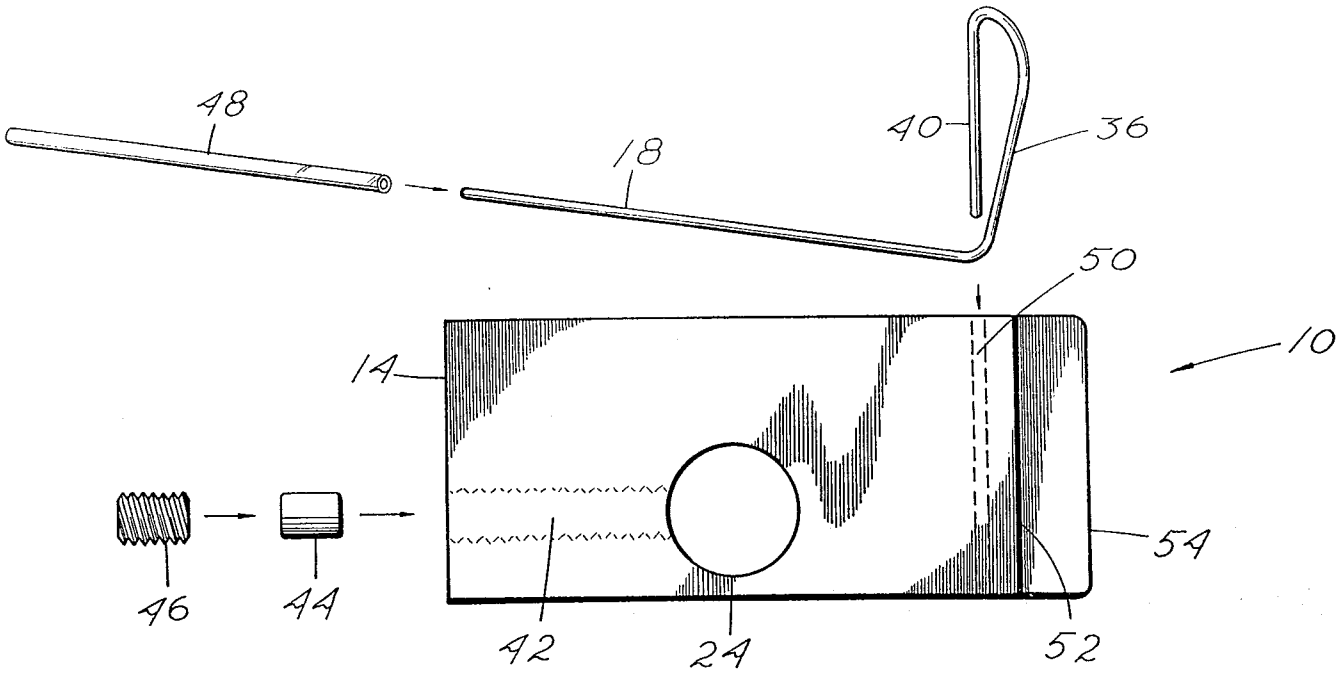
FIG. 4 shows an enlarged view of the hinge base. The arrow support lever is illustrated removed from and positioned above the lever pivotal attachment bore in the hinge base. Procedure for installation of the arrow rest lever and the locking set screw for the hinge base are indicated.

Referring now to the drawings where the preferred embodiment is shown in assembled and exploded views. The preferred embodiment of arrow guide 10 is comprised of a flat rectangular apertured plate, hinge base 14, onto which is removably affixed arrow rest lever rod 18 and hollow threaded fastener 22. Hinge base 14 is sized for mounting onto the exterior surface of bow 20 in the area of bow riser 12, as shown in FIG. 1. Hinge base 14 is held in position on bow 20 with the aid of hollow threaded fastener 22. Hollow threaded fastener 22 is an elongated externally threaded hollow screw which is first threadably inserted through an existing aperture located transversely through bow riser 12 then into hollow threaded fastener aperture 24 located on the lower central surface of hinge base 14. A portion of hollow threaded fastener 22 extends outward beyond the back surface of bow 20. Hollow threaded fastener 22 is maintained in position with the help of an internally threaded lock nut 26, which is adapted to be threaded over the exterior of hollow threaded fastener 22 and positioned adjacent the distal unthreaded portion prior to insertion into hollow threaded fastener aperture 24. The distal unthreaded end of hollow threaded fastener 22 which extends outward past the back surface of bow 20, referred to as hollow threaded fastener stop 28, serves to prevent the opposite end of hollow threaded fastener 22 from extending too far past hollow threaded fastener aperture 24 in use.

The right hand edge of hinge base 14 is adapted for removably supporting arrow rest lever rod 18. Arrow rest lever rod 18 is bent or formed into three specific sections; the first being the straight horizontal arrow support surface 16. The right end half of arrow rest lever rod 18 right angles upwards into a loop forming a section which serves as lever spring 36 then angles downward vertically truly right angled to support surface 16 to form hinge end 40. The far right edge of hinge base 14 is recessed, producing lip 54 and a narrow ledge referred to as lever backstop 52. The edge of hinge base 14 is adjacent lever backstop 52 contains a vertical unthreaded bore, designated pivotal bore 50. Hinge end 40 of arrow rest lever rod 18 is sized for releasable insertion into pivotal bore 50 with lever hinge 23 positioned against lever backstop 52. In use, arrow rest lever rod 18 self-positions laterally in an approximate forty-five degree angle relative to hinge base 14. The inherent spring action provided by lever spring 36 allows arrow support surface 16 to pivot, which helps prevent damage. Arrow support surface 16 can also be pivoted towards hinge base 14 where it rests flush against the bottom horizontal edge, whereby the correct horizontal positioning of arrow support surface 16 can be checked. Simple manual horizontal bending of arrow support surface 16 an be used should an angle greater or lesser than forty-five degrees be desired. A protective hollow tube, plastic sleeve 48, is sized for insertion over arrow support surface 16 and serves to protect the finish of arrow 32.

The interior of hollow threaded fastener 22 is adapted for housing adjustable plunger 38. Plunger 38 is an elongated cylinder with an enlarged central diameter section. One end of plunger 38 extends out through the attachment end of hollow threaded fastener 22 past hollow threaded fastener aperture 24 of hinge base 14. The interior of the attachment end of hollow threaded fastener 22 is reduced in size preventing the larger central portion of plunger 38 from exiting. The narrower terminal ends of plunger 38 however, can move freely within this reduced opening. The end of plunger 38 housed within hollow threaded fastener 22 is affixed to a compression spring 34 which is secured within hollow threaded fastener 22 by adjustment screw 30. Adjustment screw 30 is adapted to be threaded into the distal end of hollow threaded fastener 22, thereby preventing the removal of spring 34 and plunger 38. The distal end of plunger 38, which projects outward from hollow threaded fastener aperture 24, serves as a self-adjusting horizontal cushion guide for arrow 32. Spring 34 provides the self-adjustment mechanics for plunger 38, enabling plunger 38 to be retracted within hollow threaded fastener 22 eliminating further drag on arrow 32 as it is launched.

Hollow threaded fastener 22 is maintained in position within the hollow threaded fastener aperture 24 of hinge base 14 by use of soft plug 44 and set screw 46. Soft plug 44 is a small resilient cylindrical section of plastic which is sized to be inserted into a horizontal threaded bore located from the left edge of hinge base 14 to hollow threaded fastener aperture 24. This horizontal bore is referred to as threaded bore 42. Soft plug 44 is inserted into threaded bore 42 and positioned adjacent hollow threaded fastener 22. Set screw 46 is a small externally threaded screw, having one end adapted for receiving the head of an allen wrench, is threadably inserted into threaded bore 42 against soft plug 44. Soft plug 44 then prevents the free rotation of hollow threaded fastener 22 when set screw 46 is tightened.

Once arrow guide 10 has been assembled onto bow 20, the user can make final adjustments of plunger 38 by rotating hollow threaded fastener 22, either clockwise for extension or counterclockwise for retraction of plunger 38. Set screw 46 is tightened and no further adjustments are necessary. Should the level of arrow support surface 16 be in doubt, it can be pivoted toward and aligned with the bottom horizontal edge of hinge base 14. Hinge base 14 should necessarily be mounted with a square to assure correct placement on bow 20. The relatively small distal tip of plunger 38 contacting arrow 32 provides a very small surface area which reduces frictonal drag. The spring biased self-adjustment of plunger 38 and arrow support surface 16 also helps to prevent deflection of the fletching of arrow 32 as it is launched. The flexibility of the positioning of arrow support surface 16 and plunger 38 also helps to prevent damage to these devices since they are designed to yield to impacts instead of to withstand them.

Arrow guide 10 is designed to be mounted on models of bows 20 which contain an existing transverse threaded aperture in bow riser 12, thus eliminating permanent alteration to bow 20. No accessory tools are needed for the application of arrow guide 10 onto bow 20, and replacement of any or all sections can be accomplished quickly and easily for even by those not skilled in the art.

Although I have described my invention in detail in the specification and accurately depicted all components in the drawings, I assume the right to incorporate improvements, alterations and modifications into my device insofar as such changes made remain within the scope of my appended claims.

What I claim as my invention is:

1. An adjustable support for holding and guiding an arrow being launched from a bow, comprising;

a hinge base, said hinge base being a substantially rectangular plate adapted for attachment to a bow riser on an archery bow longitudinally tranverse relative to said bow length;

an arrow rest lever rod adapted for non-restrictive resting of said arrow thereon;

said arrow rest lever rod inherently structured for self spring biasing in a right angled looping end thereof with a straightened terminal section of said looping end removably attachable to said hinge base for cooperative operational activating of said spring biasing and for maintaining said arrow rest lever rod hingedly angled laterally from said hinge base;

means in said hinge base accepting removable attachment of said straightened terminal section of said looping end of said arrow rest lever rod and providing said cooperative operational activating of said self spring biased inherent in said looping end with said removable attachment being pivotal hinging for said arrow rest lever rod allowing said arrow rest lever rod to be physically movable towards said hinge base and by material reslience providing said spring biasing returned to said angled position;

said hinge base centrally opened by a threaded aperture for said attachment to said bow riser with provisions incorporated in said attachment producing a rounded end protrusion of a spring loaded plunger with said rounded end of said plunger arranged for contacting said arrow and providing a non-restrictive cushion for horizontal alignment of said arrow;

said hinge base lipped along one short end providing a backstop edge and a recess for snap-fitting retention for a first section of said looped end of said arrow rest lever rod with said backstop aligned for use with said means for attachment of said terminal end section of said looping end of said rest lever rod allowing said arrow resting portion of said arrow rest lever rod parallel positioning with a longitudinal edge of said hinge base for checking alignment and adjusting alignment of said arrow rest lever rod;

said snap-fitted retention reversible and said arrow rest lever rod entirely removable from said hinge base.

2. The adjustable support for holding and guiding an arrow being launched from a bow of claim 1, wherein said arrow rest lever rod adapted for non-restrictive resting of said arrow thereon is fitted with a smooth plastic removable covering.

3. The adjustable support for holding and guiding an arrow being launched from a bow of claim 1, wherein said means in said hinge base accepting removable attachment of said terminal end section of said looping end of said arrow rest lever rod includes a bore through an edge of said hinge base sized to pivotally retain releasably said terminal end section of said looped end of said arrow rest lever rod providing said pivotal hinging for said arrow rest lever rod with said bore aligned paralleling said lip and said backstop along one short end of said hinge base effective with said lip in retaining said arrow rest lever rod in said snap-in retention.

4. The adjustable support for holding and guiding an arrow being launched from a bow of claim 1, wherein said hinge base centrally opened by a threaded aperture for said attachment to said bow riser with provisions incorporated in said attachment producing a rounded end protrusion of a spring loaded plunger, said attachment being a hollow threaded fastener passed through an opening normally supplied on modern archery bows with external threads fitting threads in said threaded aperture in said hinge base providing said hinge base secure attachment to said archery bow riser by a lock nut tightened against the bow on the opposite side from said hinge base position, said hollow threaded fastener encasing said plunger and said spring for said spring loading thereof retained by a threaded set screw.

* * * * *